United States Patent [19]

Haller

[11] Patent Number: 4,512,386

[45] Date of Patent: Apr. 23, 1985

[54] ADJUSTABLE MOLD FOR ELECTROMAGNETIC CASTING

[75] Inventor: Walter Haller, Sierre, Switzerland

[73] Assignee: Swiss Aluminium Ltd., Chippis, Switzerland

[21] Appl. No.: 441,225

[22] Filed: Nov. 12, 1982

[51] Int. Cl.[3] ..... B22D 27/02; B22D 11/10

[52] U.S. Cl. ..... 164/467; 164/491; 164/503; 164/436

[58] Field of Search ..... 164/467, 503, 491, 436

[56] References Cited

U.S. PATENT DOCUMENTS

| | | | |
|---|---|---|---|
| 3,605,865 | 9/1971 | Getselev | 164/467 |
| 3,710,845 | 1/1973 | Burkhardt et al. | 164/436 |
| 3,964,727 | 6/1976 | Gladwin | 164/436 |
| 4,216,817 | 8/1980 | Meier | 164/467 |
| 4,307,772 | 12/1981 | Haller | 164/503 |

FOREIGN PATENT DOCUMENTS

| | | | |
|---|---|---|---|
| 756253 | 1/1971 | Belgium | 164/436 |
| 130362 | 10/1980 | Japan | 164/436 |
| 1191070 | 5/1970 | United Kingdom | 164/491 |

*Primary Examiner*—Nicholas P. Godici

*Attorney, Agent, or Firm*—Bachman and LaPointe

[57] ABSTRACT

An adjustable mold for use in electromagnetic casting systems wherein the side walls of the mold are adjustable so as to allow for the casting of ingots of various sizes by a single mold.

7 Claims, 3 Drawing Figures

ADJUSTABLE MOLD FOR ELECTROMAGNETIC CASTING

BACKGROUND OF THE INVENTION

The present invention relates to molds in metal casting systems wherein an electromagnetic inductor serves to shape molten metal prior to the solidification thereof, and more particularly, to an adjustable mold wherein the side walls of the mold are movable so as to cast ingots of various different sizes.

Electromagnetic casting systems to which the instant invention relates includes systems for electromagnetically casting wherein molten metal is introduced at a controlled rate onto a movable bottom block located within a loop-shaped electrical inductor. The bottom block is lowered at a controlled rate with metal flow being controlled in accordance with this rate to form an ingot. The molten metal so introduced is confined laterally inside the inductor by an electromagnetic field generated by an alternating current in the inductor. The molten metal is thus formed into a shape in a horizontal plane similar to the inductor. The emerging bottom block and ingot are subjected to rapid cooling by the application of a coolant, such as water, to solidify the ingot into this shape.

In most of these type systems there is a tapered electromagnetic shield or screen located inside the inductor arranged coaxially therewith made of a non-magnetic, but electrically conductive, metal, such as stainless steel. The shield, because of its taper, serves to attenuate the magnetic field of the inductor upwardly, thereby lessening the electromagnetic forces restraining the ingot at the top as opposed to those at the lower edge of the shield. The advantages of such a shield are more fully described in U.S. Pat. No. 3,605,865 to Getselev.

As is the case in the conventional casting of rectangular ingots by the direct chill method, ingots cast by the above-noted electromagnetic casting systems typically have somewhat concave side walls. The reasons for this less than ideal configuration are discussed in detail in U.S. Pat. No. 4,216,817 to Meier which is incorporated herein by reference.

Molds for use in the electromagnetic casting systems noted above are quite costly. One of the chief reasons for the high cost of the molds is due to the critical tolerances which must be maintained when machining a mold. In addition, due to the fact that numerous ingots of various sizes are normally cast, one is required to maintain an inventory of molds of various sizes which is economically undesirable. Naturally, it would be highly desirable to provide a mold for electromagnetic casting systems wherein the side walls are readily adjustable so as to enable the casting of various sizes of ingots.

Accordingly, it is the principal object of the present invention to provide an adjustable mold for use in electromagnetic casting.

It is a particular object of the present invention to provide an adjustable mold for electromagnetic casting which allows for ingots with substantially flat side walls to be cast.

It is a further object of the present invention to provide an adjustable mold for electromagnetic casting wherein the side walls are readily adjustable.

It is a still further object of the present invention to provide an adjustable mold for electromagnetic casting which is simple in construction and economic to manufacture.

Further objects and advantages of the present invention will appear hereinbelow.

SUMMARY OF THE INVENTION

In accordance with the present invention the foregoing objects and advantages are readily obtained.

The present invention comprises an adjustable mold for use in electromagnetic casting systems which allows for ingots of various sizes to be cast in a single mold. In the preferred embodiment of the present invention, the side walls of the mold may be segmented so as to assure substantially flat side walls on the cast ingots. In accordance with the present invention, the mold is provided with a first pair of opposed, segmented, stationary side walls and a second pair of opposed adjustable end walls located substantially perpendicular to the first pair of side walls so as to define a mold cavity. In accordance with the preferred embodiment of the present invention, the adjustable walls are moved along the segmented side walls and positioned at predetermined increments along the surface thereof. Small gaps of from about 1/16" to ½" are provided between the side walls and the end walls to allow for easy movement of the end walls. The gaps are beneficial in that they eliminate the need for critical tolerances associated with conventional EMC molds which greatly increase the costs of manufacturing same. Once the adjustable walls are positioned, contacts are provided between the segmented and adjustable walls to insure good contact between the inductor portions of the mold and the shield portions of the mold. Failure to maintain good contact between the shield portions will result in bad ingot surface structure.

In accordance with the present invention, relatively flat side walls can be cast by electromagnetic casting in ingots of different sizes by employing a single mold configuration having adjustable end walls and segmented side walls. The mold is simple in construction and relatively inexpensive to manufacture.

DETAILED DESCRIPTION

Figure 1:
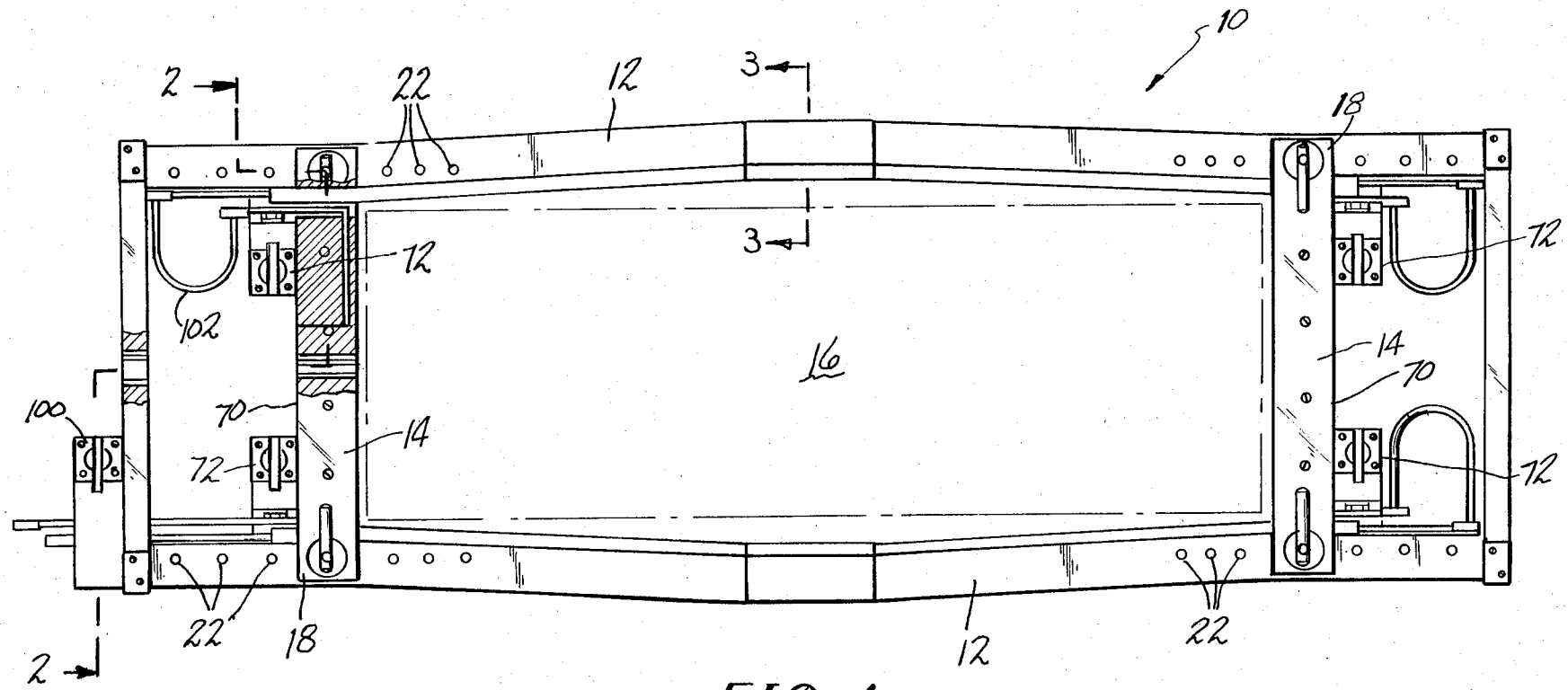
FIG. 1 is a top view of an adjustable mold for use in an electromagnetic casting system in accordance with the present invention.
Figure 2:
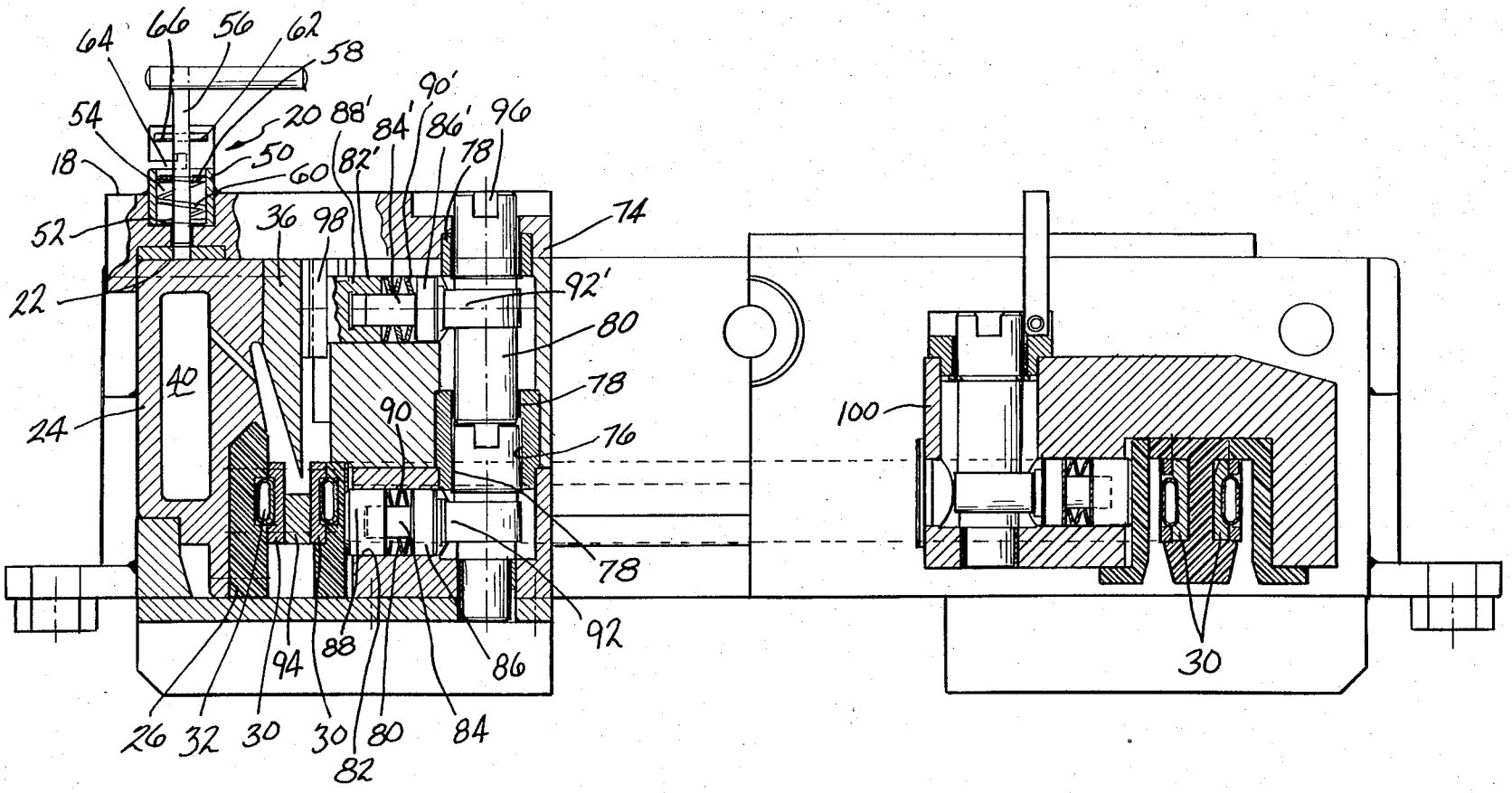
FIG. 2 is sectional view taken along line 2—2 of the adjustable mold of FIG. 1.
Figure 3:
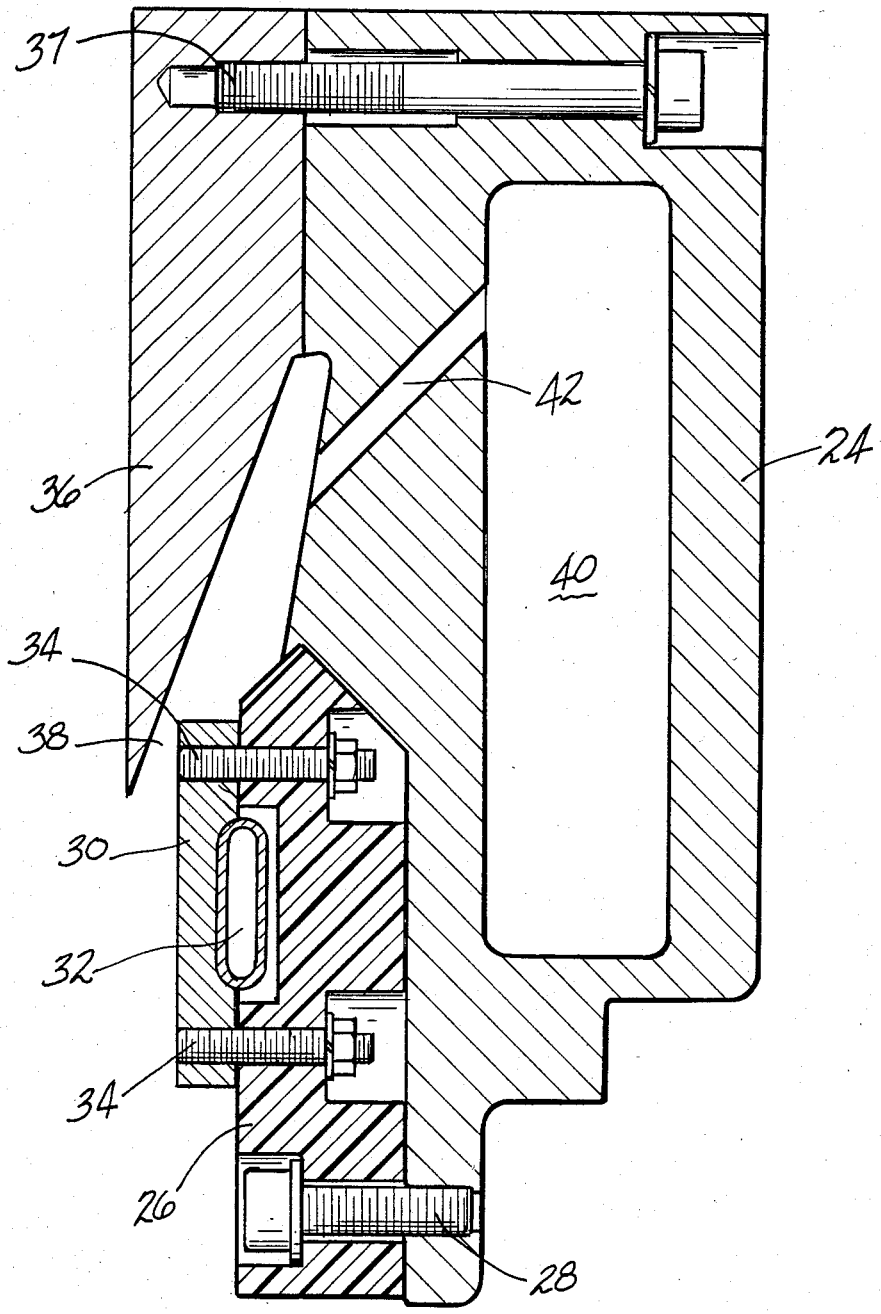
FIG. 3 is a partial sectional view taken along line 3—3 of the adjustable mold of FIG. 1.

With reference to FIGS. 1 through 3, an adjustable mold 10 is illustrated having a pair of opposed, segmented side walls 12 and a pair of movable end walls 14 which together define a mold cavity 16. Gaps of from about 1/16" to ½" are provided between the ends on the end walls 14 and the side walls 12. End walls 14 are provided with extension portion 18 adapted to slide along the top surface of side walls 12. A spring loaded detent 20 is mounted on each extension portion 18 of end walls 14 and is adapted to be received in orifices 22 located at predetermined positions on the top surface of side walls 12 for securing the end walls 14 at desired locations along the side walls 16. With particular reference to FIG. 2, detent 20 comprises a housing 50 mounted in a cut out 52 in extension portion 18. Housing 50 has a first chamber 54 which receives pin portion 56 which has secured thereto a flange 58 against which a spring 60 abuts so as to bias pin portion 56 out of engagement with orifice 22. The housing 50 is provided on the upper portion 62 thereof with a slot 64 which receives a projection 66 secured to pin 56 to hold the pin 56 against the bias of spring 60 in orifice 22 for securing the end walls 14 in place on side walls 12.

With reference to FIG. 3 the side walls 12 of the mold 10 comprises a support frame 24 having a portion of insulating material 26 secured thereto by means of bolts 28. An induction coil 30 having a cooling channel 32 is mounted to the insulating material 26 by bolts 34. Mounted on support frame 24 by bolt 37 is an electromagnetic screen 36 which forms with induction coil 30 a gap 38 for directing a coolant stream from reservoir 40 in support frame 24 via passage 42 to the surface of the ingot being cast. The end walls 14 of the mold 10 are constructed in the same manner as the side walls.

Referring again to FIGS. 1 and 2, mounted on the back face 70 of end walls 14 proximate to side walls 12 are clamping members 72 for making electrical contact between inductors 30 and screens 36 of the side walls 12 and the corresponding inductors 30 and screens 36 of end walls 14. Each clamping member 72 comprises a housing 74 having a bore 76 provided with a plurality of bearings 78 for rotatably mounting a shaft 80. As shown in FIG. 2, a pair of shafts are mounted in piggy-back fashion in bore 76. Provided in housing 74 are a pair of bores 82 and 82' which intersect bore 76. Mounted within bore 82 and 82' are clamping members 84 and 84' having a first male portion 86 and 86' and a second female portion 88 and 88' between which is mounted spring elements 90 and 90'. The spring elements 90 and 90' bias the male portions 86 and 86' against cam surfaces 92 and 92'. Male portions 86 and 86' bias female portions 88 and 88' by means of the force exerted on springs 90 and 90' by cams 92 and 92' provided on shafts 80 and 80' when the shafts 80 are rotated. As can best be seen in FIG. 2, female portion 88 biases against insulating material 26 and in turn induction coil 30. An electrically conductive body 94 is provided on one of the induction coils 30 for completing the electrical circuit between the coils. The shafts 80 are provided with slots 96 which accept a tool for rotating the shafts 80 so as to allow biasing of the clamping member 84 against the coils 30 thereby making electrical contact between the induction coils 30.

Electrical contact is made between the screens 36 in a similar manner. Screen 36 on movable end walls 14 has secured thereto an electrically conductive element 98 which is biased against screens 36 on side walls 12 by clamping members 84' in the same manner as noted above with regard to clamping member 84. An additional clamping member 100 is provided on the support frame 24 for insuring good electrical contact between induction coil 30 and the electrical input, not shown. Conduits 102 communicate cooling liquid between the cooling channels 32 of the induction coils 30.

In accordance with the present invention, in order to insure that the ingots being cast have substantially flat side walls, the side walls 12 of the mold 10 are segmented. When the location of the end walls 14 with respect to the side walls 12 is as shown in FIG. 1, the configuration of the mold 10 is ideal for producing cast ingots having flat side walls. Adjustments of the end walls 14 from that position shown in FIG. 1 results in a less than ideal mold configuration. Thus, the end walls 14 of the mold 10 can only be adjusted from the ideal location a distance which amounts to about 25–35%, preferably about 25–30% the length of the segmented side walls 12.

While there are gaps between the ends of the end walls 14 and the side walls 12, it is critical to the present invention that good electrical contact be maintained between the side wall and end wall inductor portions and shield portions. The electrical contact is made in the manner previously described. Failure to maintain good contact between the shield portions will result in bag ingot surface structure.

By way of the present invention, ingots of various sizes can be cast in a single mold while at the same time insuring substantially flat side walls on the ingots.

It is to be understood that the invention is not limited to the illustration described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for continuously casting molten metal into ingots of various sizes by electromagnetically containing and forming said molten metal comprising pouring said molten metal into a substantially rectangular shaped casting zone defined by a substantially rectangular shaped electromagnetic casting mold having side walls and end walls each having inductor portions and shield portions wherein said inductor portions induce an electromagnetic field in the casting zone so as to define the size and shape of the ingot being cast, the improvement comprising providing a gap of up to about ½" between said side walls and said end walls, adjusting the position of one of said side walls and said end walls with respect to each other so as to define the size and shape of the ingot being cast, providing electrical contact between the inductor portions of said side walls and the inductor portions of said end walls and the shield portions of said side walls and the shield portions of said end walls so as to form an inductor characterized by a closed loop and a shield characterized by a closed loop and pouring said molten metal into said casting zone while maintaining the gap between said side walls and said end walls.

2. A process according to claim 1 including the steps of providing a gap of about between 1/16" to ½" between said side walls and said end walls.

3. A mold for use in the electromagnetic casting of molten metal comprising a pair of side walls and a pair of end walls wherein said side walls and said end walls are spaced from each other so as to form a gap of up to about ½", each of said side walls and said end walls being provided with an inductor portion and a shield portion, means provided on one of said side walls and said end walls for selectively positioning and securing said one of said side walls and said end walls at different positions on the other of said side walls and said end walls for adjusting the size of the mold cavity and means for providing electrical contact between the inductor portions of said side walls and said end walls and the shield portions of said side walls and said end walls so as to form an inductor characterized by a closed loop and a shield characterized by a closed loop wherein the gap between said side walls and said end walls is maintained during the casting of molten metal into the mold.

4. A mold according to claim 3 wherein said gap is about between 1/16" and ½".

5. A process for continuously casting molten metal into ingots of various sizes by electromagnetically containing and forming said molten metal comprising pouring said molten metal into a substantially rectangular shaped casting zone defined by a substantially rectangular shaped electromagnetic casting mold having side walls and end walls each having inductor portions and shield portions wherein said inductor portions induce an electromagnetic field in the casting zone so as to define the size and shape of the ingot being cast, the improvement comprising providing a gap of up to about ½" between said side walls and said end walls, adjusting the position of one of said side walls and said end walls with respect to each other so as to define the size and shape of the ingot being cast, providing electrical contact between the inductor portions of said side walls and the inductor portions of said end walls and the shield portions of said side walls and the shield portions of said end walls so as to form an inductor characterized by a closed loop and a shield characterized by a closed loop, providing a conductive body on said inductor portions of one of said side walls and said end walls and biasing said conductive body toward the other of said side walls and said end walls so as to form said closed loop, providing a conductive body on said shield portions of one of said side walls and said end walls and biasing said conductive body toward the other of said side walls and said end walls so as to form said closed loop and pouring said molten metal into said casting zone while maintaining the gap between said side walls and said end walls.

6. A mold for use in the electromagnetic casting of molten metal comprising a pair of side walls and a pair of end walls wherein said side walls and said end walls are spaced from each other so as to form a gap of up to about ½", each of said side walls and said end walls being provided with an inductor portion and a shield portion, means provided on one of said side walls and said end walls for selectively positioning and securing said one of said side walls and said end walls at different positions on the other of said side walls and said end walls for adjusting the size of the mold cavity and means for providing electrical contact between the inductor portions of said side walls and said end walls and the shield portions of said side walls and said end walls so as to form an inductor characterized by a closed loop and a shield characterized by a closed loop provided on said inductor portion of one of said side walls and said end walls wherein the gap between said side walls and said end walls is maintained during the casting of molten metal into the mold.

7. A mold for use in the electromagnetic casting of molten metal comprising a pair of side walls and a pair of end walls wherein said side walls and said end walls are spaced from each other so as to form a gap of up to about ½", each of said side walls and said end walls being provided with an inductor portion and a shield portion, means provided on one of said side walls and said end walls for selectively positioning and securing said one of said side walls and said end walls at different positions on the other of said side walls and said end walls for adjusting the size of the mold cavity and means for providing electrical contact between the inductor portions of said side walls and said end walls and the shield portions of said side walls and said end walls so as to form an inductor characterized by a closed loop and a shield characterized by a closed loop wherein means are provided for biasing said conductive body toward the other of said side walls and said end walls so as to form said closed loop wherein said means for biasing said conductive body comprises a shaft having a cam provided thereon and a plunger reciprocally mounted in a bore contacting said cam wherein the gap between said side walls and said end walls is maintained during the casting of molten metal into the mold.

* * * * *